United States Patent [19]

Schlicter

[11] Patent Number: 4,731,943

[45] Date of Patent: Mar. 22, 1988

[54] PLANT MAINTENANCE APPARATUS

[76] Inventor: Arnold J. Schlicter, 7213 W. Chester Pike, Upper Darby, Pa. 19082

[21] Appl. No.: 874,958

[22] Filed: Jun. 16, 1986

[51] Int. Cl.[4] ..... G09F 13/18

[52] U.S. Cl. ..... 40/10 C; 40/594

[58] Field of Search ..... 40/10 C, 594; 248/551

[56] References Cited

U.S. PATENT DOCUMENTS

| | | | |
|---|---|---|---|
| 551,578 | 12/1895 | Chapman | 40/10 C |
| 2,192,514 | 3/1940 | Charleton | 40/10 C |
| 3,314,207 | 4/1967 | Sigl | 52/428 |
| 3,564,744 | 2/1971 | Shook | 40/594 |
| 4,027,410 | 6/1977 | Wheeler | 40/10 C |
| 4,655,429 | 4/1987 | Gaenzle | 248/205.3 |

OTHER PUBLICATIONS

GSA publication 481-521/32616 ©1985.
Modern Plastic, Sep. 1946, p. 11.

*Primary Examiner*—Henry E. Raduazo
*Attorney, Agent, or Firm*—Panitch Schwarze Jacobs and Nadel

[57] ABSTRACT

This invention relates to an apparatus to assist in the proper maintenance of a plant which comprises a stake for insertion into a first container containing a plant, the first container being inserted into a second container; a flexible connecting means having two ends, one end connected to the stake and the other end to an attachment means, the attachment means for attaching the connecting means to the second container.

13 Claims, 3 Drawing Figures

PLANT MAINTENANCE APPARATUS

BACKGROUND OF THE INVENTION

This invention relates to an apparatus to assist in the proper maintenance of plants. Furthermore, the invention has use in an inventory control system for effectively maintaining plants and establishing a record system regarding their care.

The increasing popularity of plants within the work and domestic environments has created a need for products which assist and educate wholesalers, floral retailers, plant maintenance technicians and general consumers regarding plant care and maintenance in a simple and easily understood manner. This is particularly true for plant maintenance firms which deal with large quantities of plants at many different locations, typically, but not exclusively, office buildings where the plants require specific, varied, periodic and individual attention for their maintenance. For example, such maintenance regimes may include specific instructions regarding the watering, pruning, light control, fertilizing, pest control techniques to be employed, means for safely cleaning a plant, and proper plant rotation and replacement procedures. Also, non-authorized maintenance and movement of the plants must be discouraged to insure plant health and contractual guarantees.

Failure to provide proper plant maintenance due to a lack of specific knowledge may adversely affect businesses in which visual impact is a major component of sales appeal. Furthermore, it is essential that sellers and maintenance firms have a simple means for keeping inventory control of the plants, not only on their customers' premises, but also in their own facilities such as greenhouses.

The present invention provides a simple, yet effective, means for assisting individuals regarding proper plant maintenance. In addition, the present invention is flexible, cost effective, and can be used in an inventory control system for tracking a plant population. Thus, businessmen and general consumers can use the present invention in a manner most suitable for their individual needs.

SUMMARY OF THE INVENTION

This invention relates to an apparatus to assist in the proper maintenance of a plant which comprises a stake for insertion into a first container containing a plant, the first container being inserted into a second container; a flexible connecting means having two ends, one end connected to the stake and the other end to an attachment means, the attachment means for attaching the connecting means to the second container. Preferably the attachment means does not harm the plant and can withstand a moist environment.

BRIEF DESCRIPTION OF THE DRAWINGS

For the purpose of illustrating the invention, there is shown in the drawings a form which is presently preferred, it being understood, however, that this invention is not limited to the precise arrangements and instrumentalities shown.

DESCRIPTION OF PREFERRED EMBODIMENT

Figure 1:
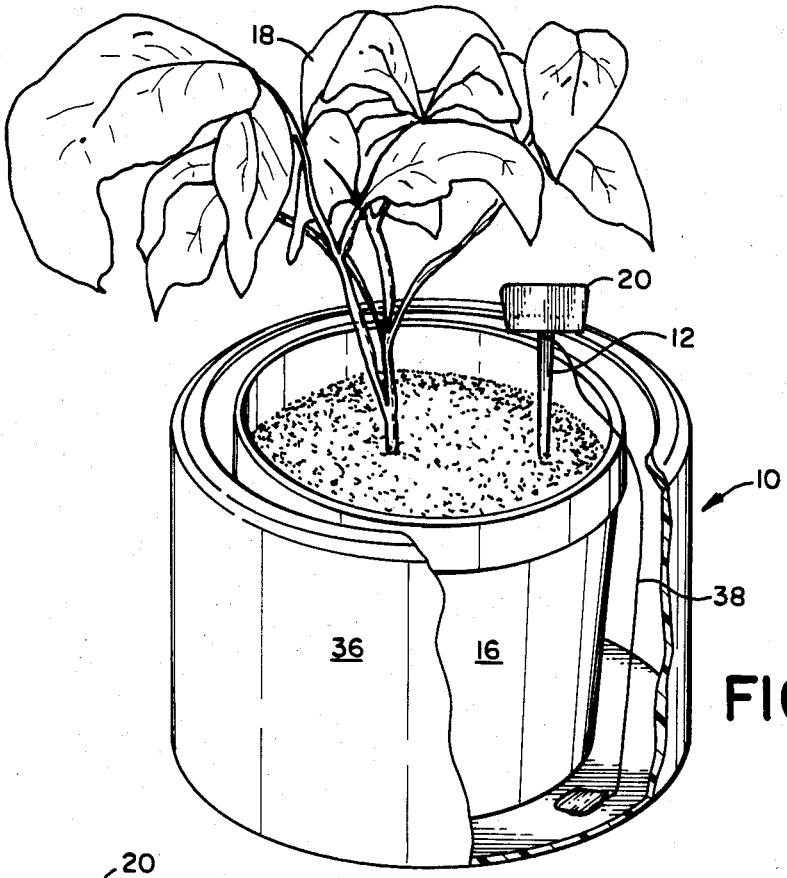
FIG. 1 is a perspective view partially broken away of the present invention in use.
Figure 2:
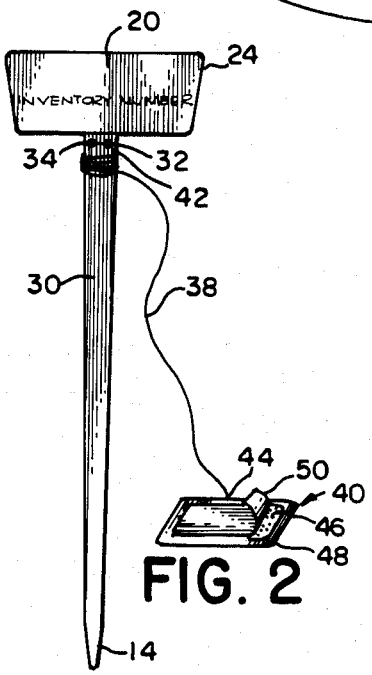
FIG. 2 is a rear elevational view of the present invention with a representation of inventory control indicia.
Figure 3:
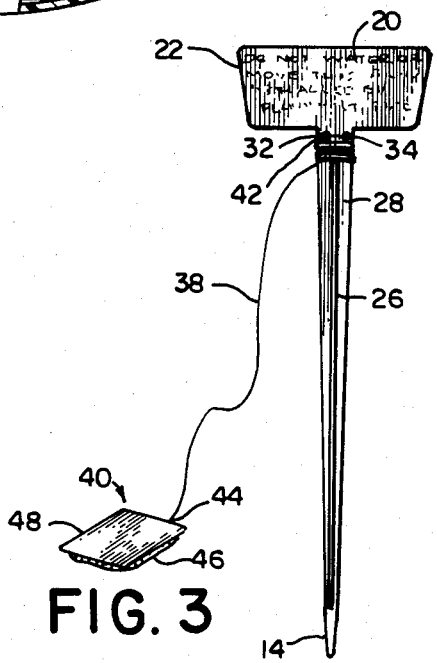
FIG. 3 is a front elevational view of the present invention with a representation of instructions for the maintenance and care of a plant.

Referring to the drawings in detail wherein like numerals indicate like elements, there is shown in FIG. 1 a perspective view of an apparatus, shown generally as 10, for assisting in the proper maintenance of a plant in accordance with the present invention. In the preferred embodiment, a major component of the invention is a stake 12, generally an elongated member tapered at one end 14, for insertion into a first container 16 containing a plant 18. The stake 12 is formed from materials preferably polymeric in nature, having sufficient tensile properties to insure support of the stake 12 in an upright position, with a limited amount of flexibility. The other end 20, or the non-tapered end, of the stake 12, as illustrated in FIGS. 2 and 3, is generally flat in nature having two major surfaces 22 and 24, respectively. In the preferred embodiment, surfaces 22, 24, respectively of the other end 20 are generally trapezoidal in shape, but are not limited to this configuration. A support ridge or rib 26, as shown in FIG. 3, extends outwardly from one surface 28 of the stake 12. The ridge 26 is medially located with respect to the surface 28 of the stake and extends downward a predetermined length toward the tapered end 14 of the stake 12. The other surface 30 of the stake 12, as shown in FIG. 2, is generally flat in nature. A pair of holes 32, 34, respectively, extend through the stake 12 proximate the end 20 for purposes which will be apparent hereinafter.

In the preferred embodiment, two major surfaces 22, 24, respectively, of the end 20 of the stake 12 include plant related indicia. The indicia are preferably displayed in a print format, but are not limited to this format. The indicia may be applied directly on the stake itself or, preferably, on a pressure sensitive adhesive label attached to the stake. It will be apparent to those skilled in the art that any suitable communication format can be applied to front surface 22 or rear surface 24, respectively, of the stake 12. The surface 22 of the stake 12, for example, the front surface as illustrated in FIG. 3, preferably includes identification and instruction-related indicia for the maintenance and care of plants. For example, front surface 22 may bear the standard, "DO NOT WATER OR MOVE. THIS PLANT PROFESSIONALLY INSTALLED AND SERVICED BY PLANTSCAPE DESIGNS, INC." The type of information on front surface 22 is intended as an identification vehicle to alert those individuals unfamiliar with the plant not to disturb the plant which may have been placed in a particular location with respect to light and heat sources, subjected to a particular water regime, etc., which, if disrupted or changed, could adversely affect the plant. Also, nonauthorized maintenance and movement of the plants must be discouraged to insure plant health and contractual guarantees. Alternately, the indicia could provide information specific to the plant relating to its particular maintenance parameters.

As illustrated in FIG. 2, the other or rear surface 24 of the stake 12 preferably includes inventory control related indicia. The type of information on the rear surface 24 is intended to aid an individual regarding the specific numerical classification of a plant, the plant owner, the date it was initially received by the owner, etc. For example, the rear surface 24 may bear the standard, "PLANT NO. 007 RECEIVED 5/14/86."

Preferably, the indicia on the front and rear surfaces 22, 24, respectively, of the stake 12 contain information which enhances the utility of the stake arrangement in an inventory control system. The system will be described in more detail hereinafter.

In the preferred embodiment, the first container 16, as illustrated in FIG. 1, is generally round with a predetermined length and is comprised of a rigid material, for example, clay or plastic. The first container 16 is constructed for suitably housing a plant 18. It will be apparent to those skilled in the art that the first container 16 may be of any desired shape and comprised of any suitable materials for housing the plant 18. Generally, the first container 16 is utilitarian in nature, rather than being decorative. The first container 16 is adapted for insertion into a second container 36 having a second predetermined diameter greater than that of the first container 16.

While the second container 36 may be comprised of any suitable material dimensioned to receive first container, in the preferred and most typical embodiment, the second container 36 is more decorative, more expensive and intended to be more permanent than the first container 16. Thus, while the first container 16 typically may be a clay or inexpensive plastic flower pot, the second container 36 is highly decorative and may be keyed to the decorating scheme of an office or home, for example. In FIG. 1, the second container 36 is shown as being made of a synthetic polymeric plastic materially merely for the purpose of illustration, it being understood that it could be decorated in an attractive manner to suit any desired taste, or be made of other materials, such as chrome, brass, wood, ceramics, etc. While the plant 18 and first container 16 may be changed, usually the second container 36 remains generally stationary in a particular location. It may be built into the permanent decor of an office or home, if desired.

A flexible connecting means 38, as illustrated in FIGS. 1, 2 and 3, having two ends, connects stake 12 with an attachment means 40. The connection means 38 is generally comprised of a waterproof synthetic polymeric material. In the preferred embodiment, the connection means is a nylon monofilament line. One end 42 of the connection means 38 is connected to a stake 12, conveniently by tying the end 42 after it has been passed through a pair of holes 32, 34, respectively. A single hole could be provided in the stake 12, as could notched areas or just areas of reduced dimension, around which the end 42 could be tied or through which the end 42 could be passed and be provided with a stop knot. Other alternative means of attaching the line 38 to the stake 12 could be provided, such as heat bonding the line to the stake, adhesive bonding, or the like.

An attachment means 40 is connected to the other end 44 of the connection means 38. The attachment means 40 attaches the end 44 of the line 38 to a secure surface. In the preferred embodiment as shown in FIG. 1, the secure surface is the internal bottom surface of the second container 36. The attachment means is generally comprised of a piece of adhesive material. In the preferred embodiment, the attachment means 40 is a strip of florist's putty 46 having two major surfaces. One major surface, as illustrated in FIG. 3, is covered with a protective layer 48 of waterproof material, preferably aluminum foil or the like, to protect or shield the adhesive material before and after it is attached to the second container 36. The protective layer 48 is effective in preventing the first container 16 from sticking to the adhesive attachment means 40, so that the first container 16 may be removed easily from the second container 36. The other major surface, as illustrated in FIG. 2, is removably secured to a release sheet 50. The release sheet 50 is comprised of a silicone coated paper, for example, and is removed to allow bonding of the adhesive material to the second container 36.

As mentioned above, the present invention has use in an inventory control system, for example, to aid a plant maintenance firm in keeping track of which plants it maintains for which customers. Particular plants in particular locations of specific customers may be assigned particular inventory control numbers and/or dates. The numbers and/or dates may be the indicia on the surface 24 as illustrated in FIG. 2. The stake 12 is inserted into the soil of the plant 18 after the line 38 has been adhesively attached to the container 36. Once the plant has been numbered and/or dated, and the number and/or date recorded on the maintenance firm's inventory sheet, the stake can be rotated so that the indicia on the front surface 22 is the primarily visible surface most of the time. Since a maintenance firm's reputation and, therefore, its customer base, depends upon the appearance of the plants it maintains, the front surface 22 may bear warning or care information as set forth above to inform people who is responsible for caring for the plant, how to care for it, etc. The indicia on the front surface 22 of the stake 12 may also include information such as the identification of the maintenance firm, advertising, or the like, useful in promoting the maintenance firm's business.

By connecting the stake via the connection means 38 and the attachment means 40 to the second container 36 or to another generally permanent and secure surface, it is less likely that the plant will be tampered with or moved. If an unauthorized person moves, destroys or injures the plant or substitutes a different plant between maintenance visits by the authorized form, the stake will remain secured to the second container or to another generally permanent surface and such activity will be apparent to the maintenance personnel on the next visit. Thus, appropriate notes can be made on the inventory control sheets of the maintenance firm and the customer's officials can be notified of the situation.

From the foregoing description of the preferred embodiment, it can be seen that the preferred embodiment comprises an apparatus to assist in the proper maintenance of a plant. It will be recognized by those skilled in the art that changes may be made to the above-described embodiment of the present invention without departing from the broad inventive concept thereof. It is understood, therefore, that this invention is not limited to a particular embodiment disclosed, but is intended to cover all modifications which are within the scope and spirit of the invention as defined in the appended claims.

I claim:

1. An apparatus to assist in the proper maintenance of a plant which comprises:

a stake for insertion into a first container containing a plant, the first container being inserted into a second container;

a flexible connecting means having two ends, one end connected to the stake and the other end to an attachment means;

the attachment means for attaching the connecting means to the second container.

2. An apparatus as recited in claim 1 wherein the stake includes two major surfaces with indicia on at least one surface.

3. An apparatus as recited in claim 1 wherein the stake includes two major surfaces with indicia on both surfaces.

4. An apparatus as recited in claim 3 wherein the indicia on one surface include instructions for the maintenance and care of the plant.

5. An apparatus as recited in claim 4 wherein the indicia on the other surface include inventory control indicia.

6. An apparatus as recited in claim 1 wherein the connecting means comprises a waterproof, synthetic polymeric line.

7. An apparatus as recited in claim 6 wherein the connection means is a nylon monofilament line.

8. An apparatus as recited in claim 1 wherein the attachment means comprises an adhesive member.

9. An apparatus as recited in claim 8 wherein the attachment means further includes a release sheet for the adhesive member which is removable therefrom prior to being attached to the second container.

10. An apparatus as recited in claim 9 wherein the attachment means further comprises a protective layer of waterproof material overlying the adhesive member to protect the adhesive member before and after it is attached to the second container.

11. An apparatus as recited in claim 1 wherein the attachment means comprises a strip of putty having two major surfaces, one major surface being covered with a protective layer of waterproof material, the other major surface having a release sheet removably secured thereto.

12. An apparatus as recited in claim 11 wherein the protective layer is an aluminum foil.

13. An apparatus as recited in claim 1 wherein the stake has at least one hole therethrough for attachment with the connection means.

* * * * *